US006366441B1

(12) United States Patent
Ozawa et al.

(10) Patent No.: US 6,366,441 B1
(45) Date of Patent: Apr. 2, 2002

(54) ELECTROMAGNETIC ACTUATOR

(75) Inventors: Hidetaka Ozawa; Yasuo Shimizu; Chihaya Sugimoto; Minoru Nakamura; Jirou Fujimoto; Toshihiro Yamaki, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/534,054

(22) Filed: Mar. 24, 2000

(30) Foreign Application Priority Data

Apr. 19, 1999 (JP) ..... 11-110963

(51) Int. Cl.[7] ..... H01H 47/28
(52) U.S. Cl. ..... 361/170
(58) Field of Search ..... 361/170, 187

(56) References Cited

U.S. PATENT DOCUMENTS 4,544,986 A 10/1985 Buchl et al. ..... 361/152
5,991,143 A * 11/1999 Wright et al. ..... 361/187
6,024,059 A * 2/2000 Kamimaru et al. ..... 361/187
6,234,122 B1 * 5/2001 Kirschbaum et al. .... 123/90.11

FOREIGN PATENT DOCUMENTS

JP 64-9827 2/1989
JP 8-284626 10/1996

* cited by examiner

*Primary Examiner*—Peter S. Wong
*Assistant Examiner*—Pia Tibbits
(74) *Attorney, Agent, or Firm*—Arent Fox Kintner Plotkin & Kahn

(57) ABSTRACT

An electromagnetic actuator is equipped with two springs which act in opposite directions, and an armature that is connected to the springs and is supported in an unactivated state in a neutral position provided by the two springs. The armature is coupled to a mechanical element such as a valve of an engine. The actuator includes a pair of electromagnets that drive the armature between a first terminal position and a second terminal position, and a power supply device that controls the voltage supplied to the electromagnet attracting the armature to a constant voltage when the armature is driven from one of the terminal positions to the other terminal position. The voltage supplied to the electromagnets is maintained at a constant value and the larger current flows in the larger is the gap between the armature and the yoke and smaller is the counter electromotive force.

14 Claims, 6 Drawing Sheets

ELECTROMAGNETIC ACTUATOR

FIELD OF THE INVENTION

The present invention relates to an electromagnetic actuator which drives a mechanical element, and more specifically concerns an electromagnetic actuator which drives an intake valve or an exhaust valve of an engine which is used, for example, in an automobile and a boat.

BACKGROUND OF THE INVENTION

Electromagnetic actuators used to drive the intake and exhaust valves of automobiles, in which an armature (movable iron piece) placed between a pair of opposing springs is driven between one terminal position and the other terminal position by alternatively supplying electric power to a pair of opposing electromagnets, are known from Japanese Patent Applicatikon Kokoku No. Sho 64-9827 and Japanese Patent Application Kokai No. Hei 8-284626, etc.

In common electromagnetic valves, an armature (valve) which is seated as a result of being attracted by one of the electromagnets is released from the seated state by stopping the power supply to the electromagnet and the armature starts to move toward a neutral position at which the opposing force of each of the two opposing springs balances. At a certain timing in synchronization with this movement, electric current is supplied to the other of the electromagnets to attract the armature.

As the armature approaches the other of the electromagnets, the magnetic flux grows abruptly as the work by the attractive force of the other of the electromagnets overcomes the sum of the slight work to draw the armature back by residual magnetic flux of the one of the electromagnets as well as a mechanical loss. Thus, the armature reaches a seated position. As seating takes place, a holding current is supplied at an appropriate timing to maintain the armature in the seated position.

In the valve operating system of an ordinary automobile engine, the amplitude of the displacement of the abovementioned armature between a pair of opposing electromagnets is 6 to 8 mm. The relationship between the attractive force of the electromagnets and the gap between the armature and the yoke is considerably nonlinear, which hinders stable operation.

In an actual valve operation, the mechanical loss varies as the engine load and other factors change so that the magnitude of the mechanical work required for making the armature seat varies (variation in the direction of the spatial axis). Furthermore, as it is not easy to maintain a constant magnetic force for holding the armature in the seated position, there is some variation in the residual magnetic flux when the armature is released. As a result, the dead time (delay: idle time, delay time) from the time when the power supply to the electromagnet is stopped to the time when the armature actually departs the seated position varies (variation in the direction of the time axis).

Conventional electromagnetic actuator driving scheme is essentially unstable with respect to such variations in the direction of the spatial axis and variations in the direction of the time axis.

The driving conditions of the armature in a common conventional electromagnetic actuator will be described with reference to FIG. 4(A). The curve (a) indicates the movement of the armature. The position marked as 0 mm on the left vertical axis indicates the first terminal position. The other or second terminal position is located 7 mm from the first terminal position. When the armature is driven from the first terminal position toward the second terminal position, the armature first begins to move toward the neutral position (where the force of a pair of opposing springs balances) as the current for holding the armature in the first terminal position is cut off. In FIG. 4(A), the armature reaches the neutral position in approximately 3 milli-seconds. When the armature has more or less reached the neutral position, a constant current (b) (2 amperes in the case of the present example) is supplied to the second electromagnet to generate an attractive force (d) that attracts the armature toward the second terminal position. This attractive force (curve d) reaches 600 Newtons at the time of seating, which greatly exceeds the minimum attractive force of 300 Newtons needed for attracting the armature. Curve (f) indicates the level of the minimum attractive force that is required for having the armature seat (this is the same in the following figures).

The voltage applied to the second electromagnet is indicated by curve (c). A rectangular wave voltage with a base frequency of 20 kHz or greater is applied by means of pulse width modulation (PWM) from a 100 V power supply in order to maintain a constant current (b). In the figure, this is indicated as a mean voltage (c) in terms of a moving average. When the armature is seated, the current supplied to the coil is switched to a holding current of approximately 0.5 amperes as shown in the curve (b).

If friction increases for some reason, the attractive force drops. FIG. 4(B) shows the attractive force (d) obtained by supplying a constant current in a case where the friction is 1.5 times the standard friction. In this case, the peak attractive force does not reach the level (f) needed for seating. Thus, the armature cannot reach or seat on the electromagnet. It will oscillate between the two electromagnets by the action of the pair of springs as can be seen from curve (a).

The causes of this problem are thought to be as follows:

1) When the armature is released, the armature is driven toward the opposite electromagnet by the potential energy of the spring. However, as a result of the increase in friction, the proportion of the potential energy of the spring that is converted into kinetic energy of the armature or valve drops. In other words, the distance the armature can travel without power supply decreases.
2) Accordingly, when friction is larger, if current is supplied with the same timing on the time axis, the gap between the armature and the yoke is larger than when there is a standard friction. Since the gap is larger, the rise in the magnetic flux is blunted and the counter electromotive force generated in a driving coil of the electromagnet is also smaller. Consequently, the voltage required to provide the same current flow reduces and the voltage peak lowers. Thus, the flow of electric power (terminal voltage×current) into the electromagnets from the power supply drops, which further slows down growth of the magnetic flux and the attractive force. This way, when the friction becomes large enough to reach a boundary value, the actuator becomes unable to attract the armature.

SUMMARY OF THE INVENTION

In accordance with one aspect of the invention, an electromagnetic actuator comprises two springs which act in opposite directions, an armature which is connected to the springs and is supported in an unactivated state in a neutral position provided by the two springs. The armature is coupled to a mechanical element such as a valve of an engine. The actuator includes a pair of electromagnets that drive the armature between a first terminal position and a second terminal position. It also includes a power supply that controls the voltage supplied to the electromagnet attracting the armature to a constant voltage when the armature is driven from one of the terminal positions to the other of the terminal positions.

As the armature is released from the seated position, it moves toward the electromagnet on the opposite side by the potential energy of the spring. The distance the armature travel reduces with increased friction. Thus, the gap between the armature and the yoke increases causing the counter electromotive force to decrease as described above. In the present invention, the voltage supplied to the electromagnet is maintained at a constant value. Accordingly, if the counter electromotive force decreases, larger current flows in and the power supply (terminal voltage×current) to the electromagnet increases. As a result, slowdown of growth of the magnetic flux is prevented and a large attractive force grows. Accordingly, increase in the friction is not a problem as in the prior art.

In accordance with another aspect of the invention, the electromagnetic actuator comprises two springs which act in opposite directions, an armature that is connected to the springs and supported in an unactivated state in a neutral position provided by the two springs. The armature is coupled to a mechanical element such as a valve of an engine. The actuator includes a pair of electromagnets that drive the armature between a first terminal position and a second terminal position and a pulse-modulation driver that selectively supplies voltage pulses with a variable duty ratio to the pair of electromagnets.

The actuator further includes a controller that controls the duty ratio such that the electric power needed to generate a sufficient attractive force for attracting the armature is supplied when the armature is driven from one of the terminal positions to the other terminal position. The electric power to be applied can be set beforehand. Accordingly, lowering of the speed of armature movement for soft seating and other controls can be positively performed.

DETAILED DESCRIPTION OF PREFERRED EMBODIMENTS OF THE INVENTION

Figure 1:
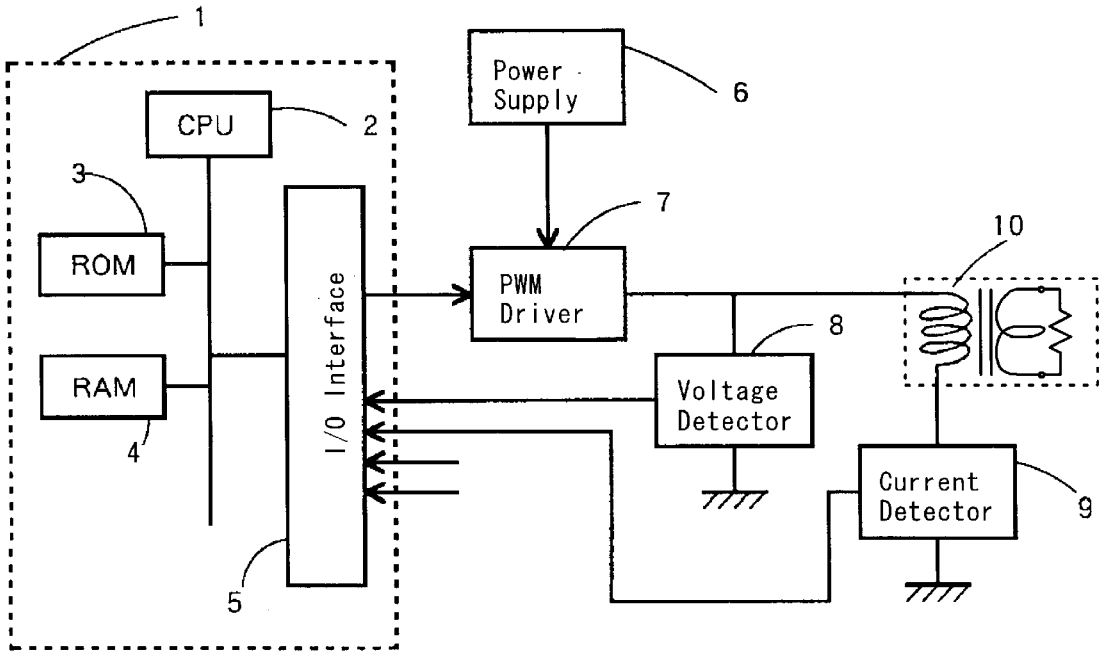
FIG. 1 is a block diagram illustrating the overall construction of the electromagnetic actuator of the present invention.

Next, preferred embodiments of the present invention will be described with reference to the attached drawings. FIG. 1 is a block diagram illustrating the overall construction of the electromagnetic actuator according to one embodiment of the present invention. The controller 1 is equipped with an operating unit (CPU) 2, a read-only memory (ROM) 3 that stores control programs and data, a random-access memory (RAM) 4 that temporarily stores data, and that provides the operational working area of the CPU 2, and an input-output interface 5.

Figure 2:
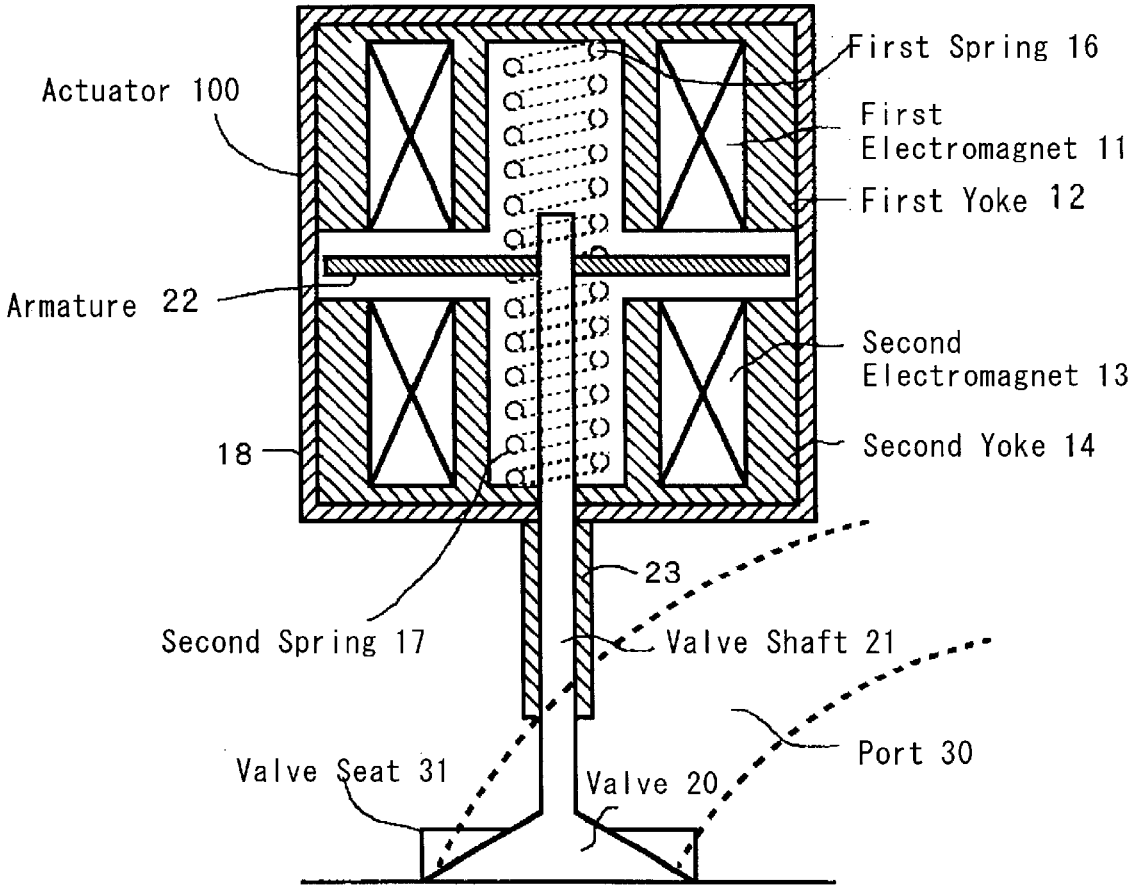
FIG. 2 is a sectional view of one example of an electromagnetic actuator.

The electromagnet 10 indicates a first electromagnet 11 or a second electromagnet 13 of the electromagnetic actuator 100 shown in FIG. 2. The PWM (pulse width modulation) driver 7 subjects the voltage supplied from a constant-voltage power supply 6 to pulse width modulation in accordance with control signals from the controller 1, and supplies the modulated voltage to the electromagnet 10. A voltage detector 8 detects the voltage of the electric power supplied to the electromagnet 10 and a current detector 9 detects the current. The constant-voltage power supply 6 is a power supply that boosts the voltage of 12 V that is supplied from the vehicle-mounted battery, and supplies a constant voltage of 30 to 100 V for example.

The input-output interface 5 of the controller 1 receives voltage signals from the voltage detector 8, current signals from the current detector 9, pulse signals indicating a crank angle and engine rpm (from an rpm sensor), and signals from a temperature sensor of the electromagnetic actuator 100. On the basis of these inputs, the controller 1 determines parameters such as the timing of the supply of electric power, the magnitude of the voltage to be supplied, and the duration for applying the voltage in accordance with a control program stored in the ROM 3.

Figure 3A:
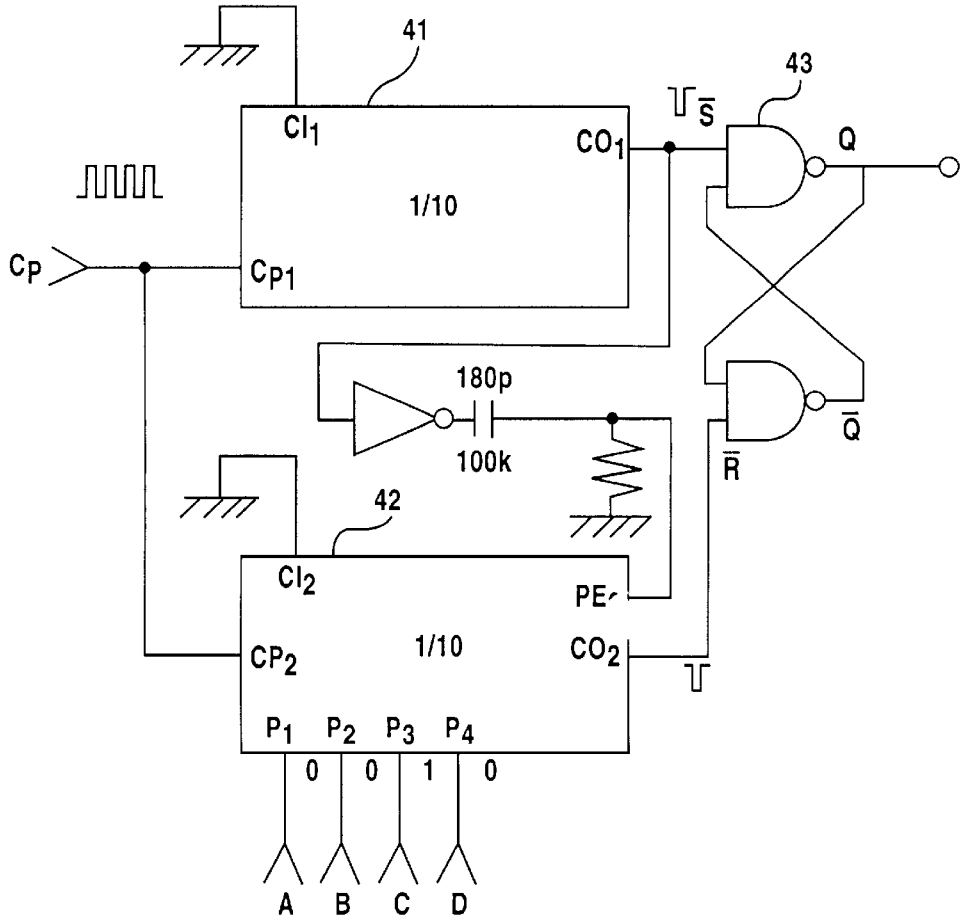
FIG. 3 is a block diagram showing the construction of the PWM driver.

As is shown in FIG. 3(A), the PWM driver is equipped with a counter 41 that counts, from 0 to 9, clock pulses Cp of a base frequency of for example 100 kHz provided by an internal clock. It is also provided with a pre-settable countdown counter 42 with the same number of bits as the counter 41. The PWM driver 7 generates pulses with period T1 that is the time the counter 41 carries out a full count of the clock pulses Cp and with a pulse width of time T2 that corresponds to the values set in the program-input terminals P1 through P4 of the countdown counter 42.

Figure 3B:
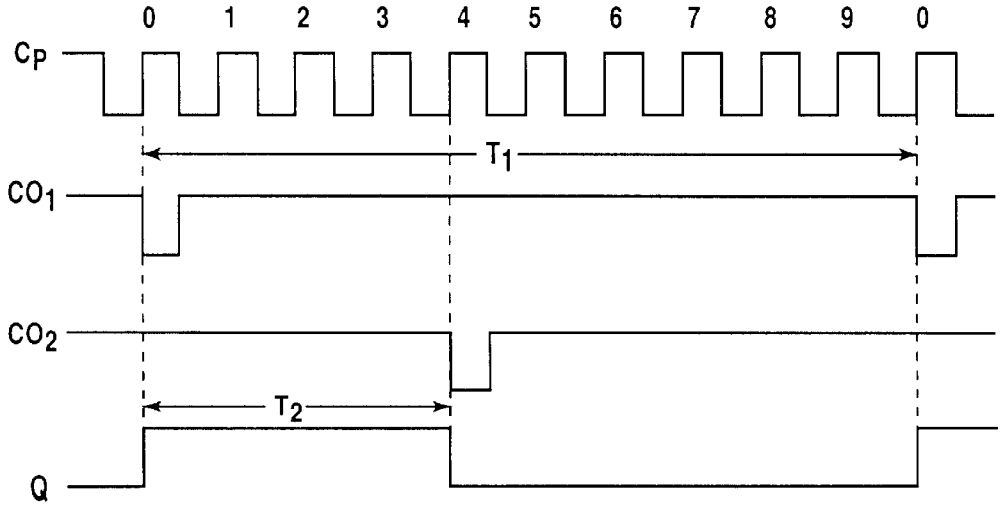

Referring now to FIG. 3(B), each time that the counter 41 counts ten clock pulses Cp, a $CO_1$ output is sent out, and the flip-flop 43 is set. The countdown counter 42 is set with the program input from the controller 1 to 0100 for example at the same time as the $CO_1$ output, and a countdown is initiated. When the countdown counter 42 reaches 0, it sends out a $CO_2$ output and resets the flip-flop 43. Thus, a pulse with a pulse width that is proportional to the program input is obtained at the Q output of the flip-flop 43.

The PWM driver switches, in accordance with the output Q of the flip-flop, the voltage of 100 V, for example, supplied from the constant-voltage power supply 6, and supplies a rectangular pulse with a width of period T2 to the terminals of the electromagnet 10. In this example, the rectangular pulse has a pulse width of period T2 corresponding to four clock pulses. The period T1 corresponds to 10 clock pulses. As such, T2 is 40% of T1 and the duty ratio of the rectangular pulse is 40%. The rectangular pulse is supplied to the electromagnet 10.

The controller 1 drives the PWM driver 7 with a predetermined timing in accordance with a control program stored in the ROM 3. Furthermore, the controller 1 monitors the value of the voltage that is sent from the voltage detector 8. When the voltage drops below a certain value, the controller 1 increases the value of the program input set in the countdown counter 42 of the PWM driver 7 so as to increase the duty ratio of the voltage pulse. Moreover, when the value of the voltage that is sent from the voltage detector 8 exceeds a certain value, the controller 1 reduces the value of the program input set in the countdown driver 42 so as to lower the duty ratio of the voltage pulse. As a result of the response to variations in the voltage, the voltage that drives the electromagnet 10 is controlled to a constant value.

In one embodiment of the present invention, the electric power that is used to hold the armature in a seated position is supplied as a constant current. In this operating mode, the controller 1 sends a control signal to the PWM driver 7 to switch the constant-voltage power supply to a 12 V power supply, and a voltage pulse with a wave height value of 12 V is supplied to the electromagnet 10. The controller 1 monitors the current value sent from the current detector 9, and controls the duty ratio of the voltage pulse so that a constant current is supplied to the terminals of the electromagnet 10.

FIG. 2 is a sectional view showing the schematic structure of the electromagnetic actuator driven by the controller of the present invention. The structure of this electromagnetic actuator itself belongs to the prior art. When the valve 20 is driven upward by the electromagnetic actuator 100, it is stopped at a position where it is tightly seated on a valve seat 31 installed in an engine intake port or exhaust port (hereafter referred to as "intake/exhaust port") 30 so that the intake/exhaust port 30 is closed. When the valve 20 is driven downward by the electromagnetic actuator 100, the valve 20 leaves the valve seat 31, and is lowered to a position that is separated from the valve seat 31 by a specified distance so that the intake/exhaust port is opened.

The valve shaft 21 extending from the valve 20 is held in a bore of a valve guide 23 to enable it to move in an axial direction. A disk-like armature 22 made of a soft magnetic material is attached to the upper end of the valve shaft 21. A first spring 16 and a second spring 17 jointly supports the armature 22 in the middle of the space between a first electromagnet 11 and a second electromagnet 13.

The first solenoid type electromagnet 11 that is positioned above the armature 22 and the second solenoid type electromagnet 13 that is positioned beneath the armature 22 are installed inside the housing 18 of the electromagnetic actuator 100. The housing 18 is made of a non-magnetic material.

The first spring 16 and second spring 17 are installed in a balanced configuration so that the armature 22 is held in the middle of the gap between the first electromagnet 11 and second electromagnet 13 when no driving current is applied to either the first electromagnet 11 or second electromagnet 13.

Figure 5A:
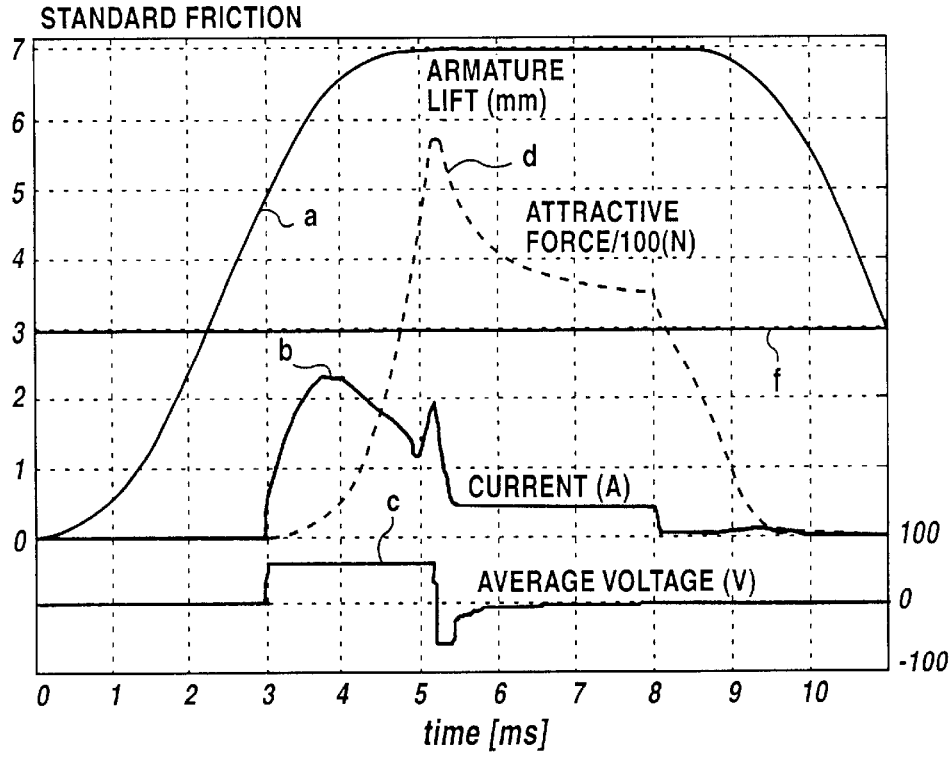
FIG. 5 shows the characteristics obtained during then driving of the electromagnetic actuator in one embodiment of the present invention.

The driving scheme of the electromagnetic actuator 100 in accordance with one embodiment of the present invention will be described with reference to FIG. 5. FIG. 5(A) shows the relationship of the armature lift (a), which indicates the movement of the armature 22 under a standard frictional condition. The current that is supplied to the electromagnet is shown by curve (b), and the voltage that is supplied to the electromagnets is shown by curve (c). The attractive force that is generated by the electromagnets is shown by curve (d).

When the holding current supplied to the second electromagnet 13 is stopped when the armature 22 is seated on the second yoke 14 and the valve 20 is opened, the armature 22 is released from the second yoke 14 and begins to move toward the first electromagnet by means of a potential energy of the first spring 16 and the second spring 17. Around the time that the armature reaches the neutral position in which the forces of the first and second springs are balanced (3 ms after the armature begins to move), the controller 1 sends a control signal to the PWM driver 7 to apply a constant voltage (c) to the first electromagnet 11.

When the voltage supply is initiated, the gap between the armature and yoke is large. Thus, a counter electromotive force generated in the first electromagnet 11 is small. Since the voltage supplied to the electromagnet 11 is controlled to be at a constant value, the current supplied by the PWM driver 7 increases as seen from curve (b) as an electrical load reduces. Accordingly, the supply of electric power (terminal voltage×current) into the electromagnets increases. As a result, the magnetic flux generated by the first electromagnet 11 increases and an attractive force grows as shown by curve (d), FIG. 5(A).

Figure 5B:
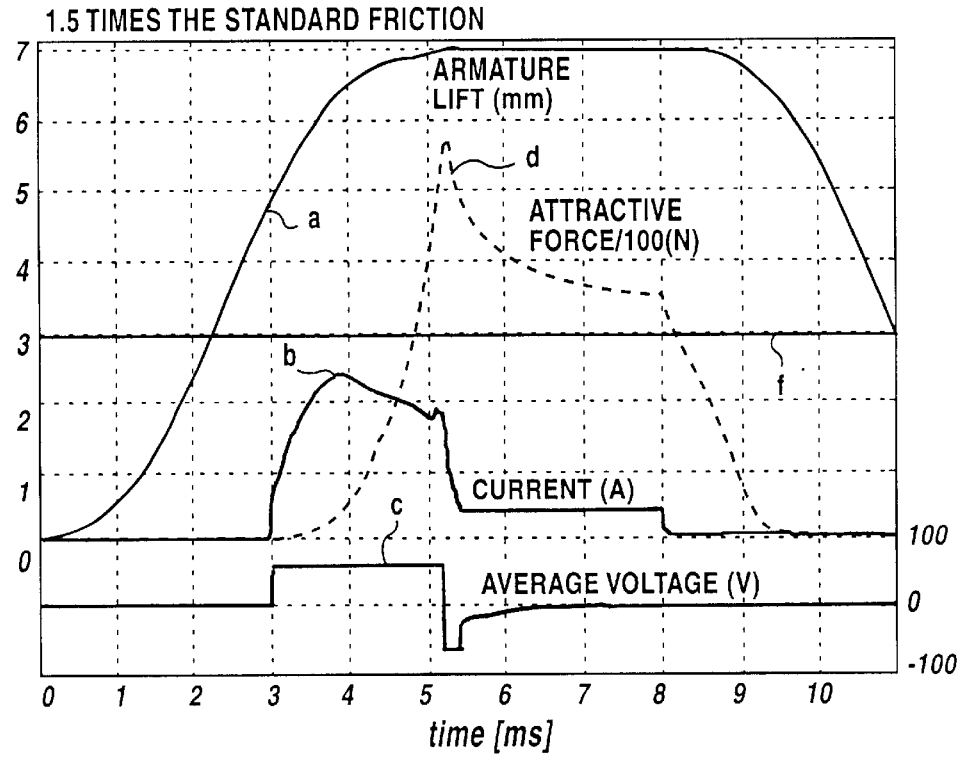

When the armature 22 reaches the electromagnet 11 and is seated, the supply of the constant voltage is stopped, and the system switches to a constant-current mode. In the constant current mode, a holding current of approximately 0.5 amperes is applied to the coil of the electromagnet 11. In FIGS. 5(A) and 5(B), switching to the constant-current mode is carried out in the vicinity of 5.2 milliseconds. It is well known in the art to apply holding current to the electromagnet while the armature 22 is seated.

Figure 4A:
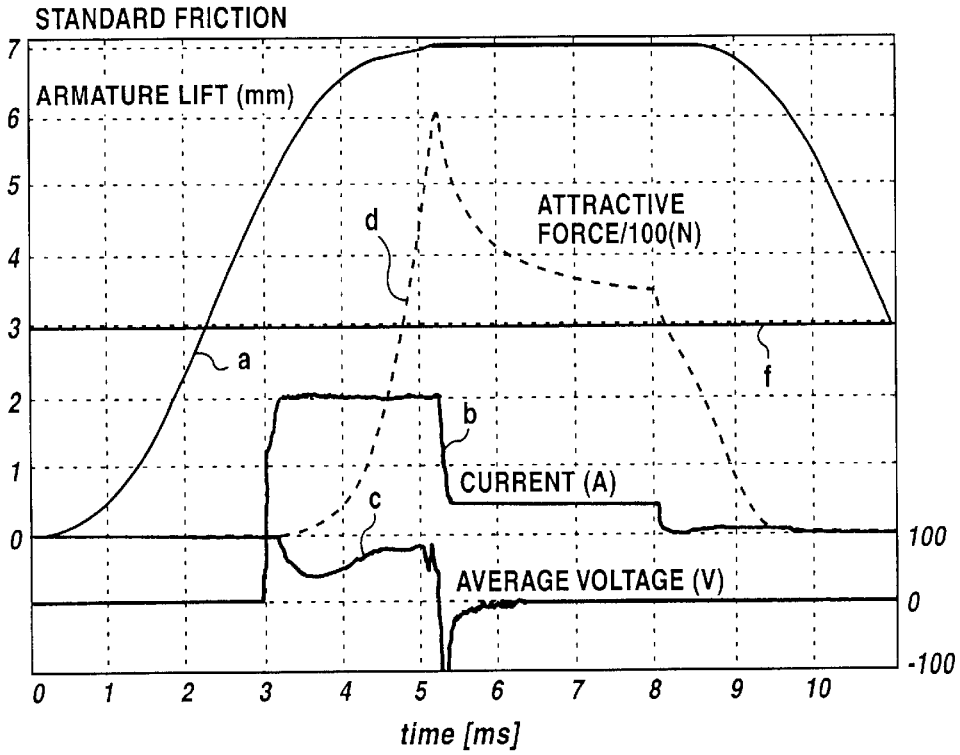
FIG. 4 shows the characteristics obtained when the electromagnetic actuator is driven by means of a conventional constant-current system.
Figure 4B:
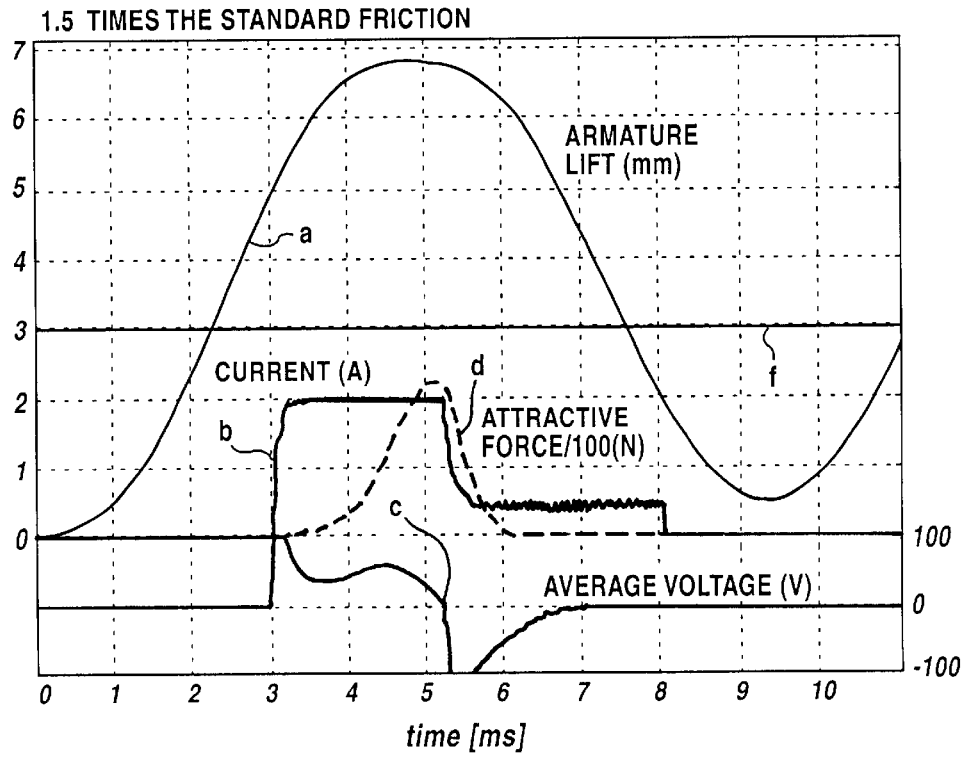

FIG. 5(A) shows the characteristics under standard friction conditions. FIG. 5(B) shows the characteristics when friction of the armature is 1.5 times that of standard friction. In the case of FIG. 5(B), since the friction of the armature is large, the distance by which the armature moves by means of a spring energy after the armature is released from the second electromagnet 13 is smaller than in the case of the standard friction. Accordingly, at the time that the constant voltage is applied to the first electromagnet 11, the gap between the armature and the first electromagnet is larger than that in the case of the standard friction condition. As a result, the counter electromotive force generated in the first electromagnet 11 is smaller than in the case of standard friction condition. The PWM driver 7 controls the voltage (c) applied to the first electromagnet 11 at a constant level. Thus, if the counter electromotive force is small, a correspondingly large current (b) flows into the first electromagnet 11. Thus, the first electromagnet 11 generates a large attractive force (d) to attract the armature 22 toward the first electromagnet 11. Accordingly, increased friction does not lead to unstable operation of the actuator as in the case of a conventional driving scheme of the type described above with reference to FIG. 4.

At the time when the armature 22 seats on the yoke of the first electromagnet 11, or immediately prior to the seating, application of the constant voltage to the coil of the first electromagnet 11 is stopped, and the system switches to apply a holding current of approximately 0.5 amperes.

In another embodiment of the present invention, the time variation of the electric power supplied to the electromagnets is set beforehand, and the duty ratio of the constant-voltage pulse supplied to the electromagnets is controlled such that the supplied electric power conforms to the preset time variation. In concrete terms, referring again to FIG. 1, the controller 1 controls the PWM driver 7 to increase the duty ratio if the supplied electric power, which is obtained as the product of the coil current detected by the current detector 9 and the mean voltage detected by the voltage detector 8, is smaller than the value of the corresponding electric power in the preset electric power supply pattern. On the other hand, if the supplied electric power is larger than the value of the corresponding electric power in the preset electric power supply pattern, the controller 1 controls the PWM driver 7 to decrease the duty ratio. In this embodiment, since the duty ratio of the voltage pulse is caused to vary by a large amount, the mean voltage supplied to the electromagnets varies with time.

Figure 6:
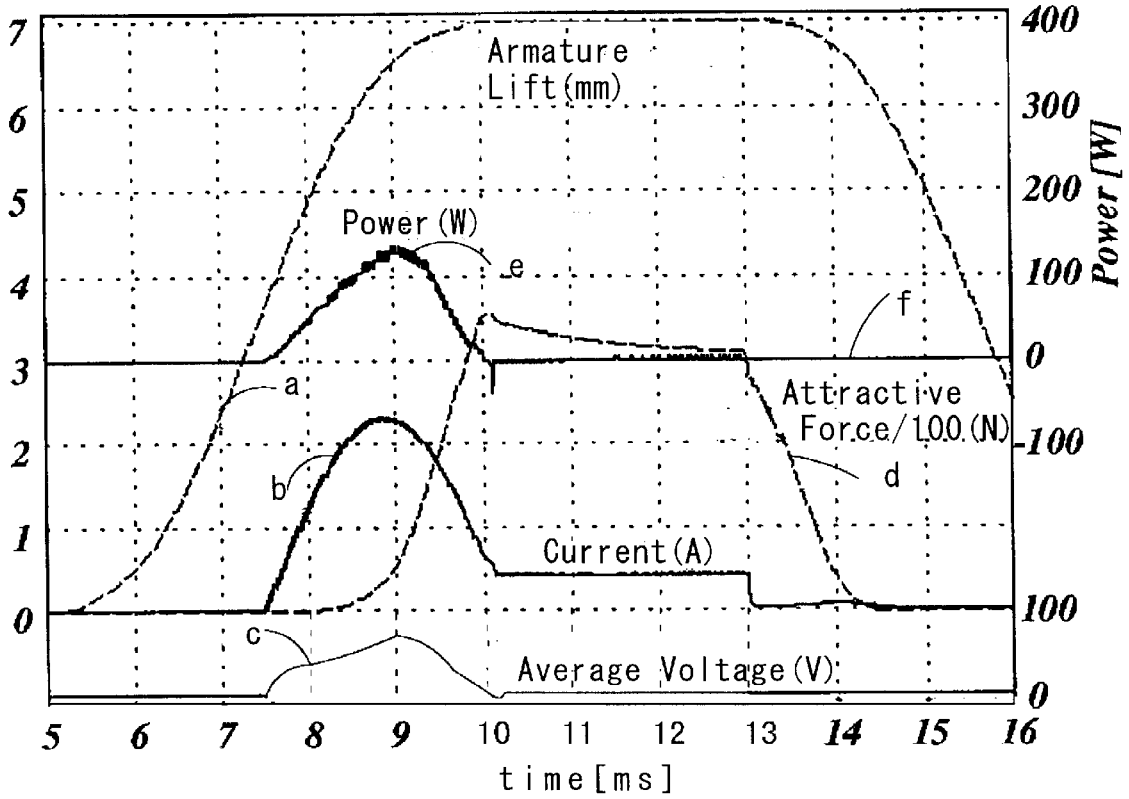
FIG. 6 shows the characteristics obtained during the driving of the electromagnetic actuator in another embodiment of the present invention.

FIG. 6 shows the relationships of the armature lift (a), current (b), voltage (c), attractive force (d) and electric power (e) in the embodiment. The voltage is supplied in the form of a constant-voltage pulse with a variable duty ratio. It is shown in terms of a mean value in the figure. In this example, the controller is programmed so that electric power with a pattern such as that indicated by the curve (e) is applied to the electromagnets when the armature reaches the neutral position.

In the embodiment, the electric power supply pattern for attracting the armature in the terminal positions is programmed beforehand, and electric power conforming to the programmed pattern is supplied to the electromagnets. Accordingly, it reduces unstable operation caused by variations in friction experienced in the prior art. Furthermore, the pattern of the supplied electric power may be programmed beforehand so that the armature may seat smoothly onto the electromagnet without causing excessive impact against the yoke of the electromagnet.

When the armature is seated, or immediately prior to the seating of the armature, the power supply to the electromagnets is switched to a mode for supplying a holding current of approximately 0.5 amperes.

It will be understood that the invention may be embodied in other forms without departing the scope of the invention. The above embodiments are described for illustrative purpose and not restrictive.

What is claimed is:

1. An electromagnetic actuator comprising:

two springs acting in opposite directions;

an armature connected to the springs and supported in a neutral position provided by the two springs when in an unactivated state, said armature being joined to a mechanical element;

a pair of electromagnets for driving the armature between a first terminal position and a second terminal position; and a controller for controlling voltage supplied to a selected one of the electromagnets at a constant voltage when the selected electromagnet is activated to attract the armature from the first terminal position to the second terminal position.

2. An electromagnetic actuator according to claim 1, further comprising:

a voltage detector connected to each of said electromagnets for detecting voltage applied thereto; and a pulse width modulation driver responsive to signals from said controller for producing a pulse width modulation output to be applied to the selected one of the electromagnets.

3. An electromagnetic actuator according to claim 2, wherein said controller, responsive to the voltage detected by said voltage detector, controls a duty ratio of the output of said pulse width modulation driver such that the voltage applied to selected one of the electromagnets is kept constant.

4. An electromagnetic actuator according to claim 3, further comprising a constant voltage power source for supplying the constant voltage to said pulse width modulation driver.

5. An electromagnetic actuator for driving a valve of an engine comprising:

two springs acting in opposite directions;

an armature connected to the springs and supported in a neutral position state provided by the two springs when in an unactivated state, said armature being joined to said valve;

a pair of electromagnets for driving the armature between a first terminal position and a second terminal position;

a pulse width modulation driver for supplying a voltage pulse with a variable duty ratio; and a controller for controlling the variable duty ratio such that electric power required to generate a sufficient attractive force is supplied to a selected one of the electromagnets when the armature is driven from the first terminal position to the second terminal position.

6. An electromagnetic actuator according to claim 5, wherein the selected one of the electromagnets is activated in a constant voltage mode to attract the armature thereto and said selected one of the electromagnets remains activated but in a constant current mode when the armature is seated.

7. An electromagnetic actuator according to claim 5, further comprising:

a voltage detector connected to each of said electromagnets for detecting voltage applied thereto; and a current detector connected to each of said electromagnets for detecting current flowing therein.

8. An electromagnetic actuator according to claim 7, wherein said controller, responsive to the voltage detected by said voltage detector, controls the variable duty ratio of the output of said pulse width modulation driver such that the voltage applied to the selected one of the electromagnets is kept constant when the armature is to be attracted to the selected one of the electromagnets.

9. An electromagnetic actuator according to claim 7, wherein said controller, responsive to the current detected by said current detector, controls said pulse width modulation driver such that the current supplied to selected one of the electromagnets is kept constant when the armature is seated on the selected one of the electromagnets.

10. An electromagnetic actuator according to claim 5 wherein said controller is programmed to supply electric power to the selected one of the electromagnets in a predetermined pattern when the armature is to be attracted to the selected one of the electromagnets.

11. A method of driving a valve of an engine with an electromagnetic valve actuator having a first electromagnet for closing the valve, and a second electromagnet for opening the valve, comprising the steps of:

activating the first electromagnet with a constant voltage to drive the valve from an open position to a closed position;

cutting off the constant voltage when the valve reaches the closed position; and supplying a constant current to the first electromagnet to hold the valve in the closed position when the valve reaches the closed position.

12. A method according to claim 11 wherein the step of activating the first electromagnet comprises the step of controlling a duty ratio of electric pulses to be supplied to the first electromagnet so as to generate a sufficient attractive force.

13. A method according to claim 11, further comprising the steps of:

cutting off the constant current supplied to the first electromagnet; and activating the second electromagnet with a second constant voltage to drive the valve from the closed position to the open position.

14. A method according to claim 13, further comprising the steps of:

cutting off the second constant voltage when the valve reaches the open position; and supplying a second constant current to the second electromagnet to hold the valve in the open position after the valve reaches the open position.

* * * * *